United States Patent [19]

Wedekind et al.

[11] 3,930,708

[45] Jan. 6, 1976

[54] FLAT CABLE WIRE-CONNECTOR

[75] Inventors: Albert D. Wedekind, West St. Paul; John W. Benzer, East Bethel Township, Anoka County, both of Minn.

[73] Assignee: Minnesota Mining and Manufacturing Company, St. Paul, Minn.

[22] Filed: Sept. 9, 1974

[21] Appl. No.: 504,135

[52] U.S. Cl. ..... 339/99 R

[51] Int. Cl.[2] ..... H01R 11/20

[58] Field of Search ..... 339/97 R, 97 C, 97 P, 98, 339/99 R

[56] References Cited

UNITED STATES PATENTS

| | | | |
|---|---|---|---|
| 3,434,093 | 3/1969 | Wedekind | 339/99 R X |
| 3,605,071 | 9/1971 | Sedlacek | 339/97 P |
| 3,805,214 | 4/1974 | Demler et al. | 339/97 R X |
| 3,816,818 | 6/1974 | Meier | 339/99 R |
| 3,820,055 | 6/1974 | Huffnagle et al. | 339/97 P X |
| 3,820,058 | 6/1974 | Freind | 339/99 R |

*Primary Examiner*—Joseph H. McGlynn
*Assistant Examiner*—Howard N. Goldberg
*Attorney, Agent, or Firm*—Alexander, Sell, Steldt & DeLaHunt

[57] ABSTRACT

A solderless connector for making electrical contact with the closely spaced wires of a compact flat cable, wherein the contact elements comprise two coplanar sharpened flat outer prongs and a sharpened flat central prong parallel to, and displaced from the plane of, said outer prongs.

3 Claims, 11 Drawing Figures

FLAT CABLE WIRE-CONNECTOR

BACKGROUND OF THE INVENTION

This invention relates to wire-connectors and more particularly to solderless connectors for making permanent electrical connection to the closely spaced wire conductors of compact flat cables.

Wire connectors for flat cables, as described in U.S. Pat. Nos. 3,434,093 and 3,444,506, employ bifurcate flat plate contact elements positioned in planes perpendicular to the wires. The elements are forced through the plastic insulation and onto the conductors, causing slight resilient separation of the two prongs in the plane of the plate and resulting in permanent spring compression reserve contact. The width of the elements must be sufficient to provide the required resiliency and avoid permanent deformation while still permitting the required separation, but must be substantially less than the spacing between adjacent wires in order that adequate insulation between wires and elements may be maintained. These requirements have been fully met in connectors for cables containing No. 28 or No. 30 gage solid copper wires on 0.05 inch centers. In such connectors the contact elements are required to have a width of at least four, preferably five times the thickness of the plate. For cables with more closely spaced wires, difficulty has occasionally been experienced with these prior art structures in obtaining fully effective contact while retaining required insulating value.

The present invention makes possible a significant reduction in the width of the contact element while still affording permanent full contact, and thereby permits the effective use of flat cables having extremely close wire spacings of the order of 0.0425 to 0.0250 inch.

It has now been found possible, in accordance with the principles of the invention, to reduce the over-all width of the contact element to not more than three times the thickness of the metal plate. Such reduction is achieved by means of novel structure as illustrated in the accompanying drawing, wherein.

Figure 1:
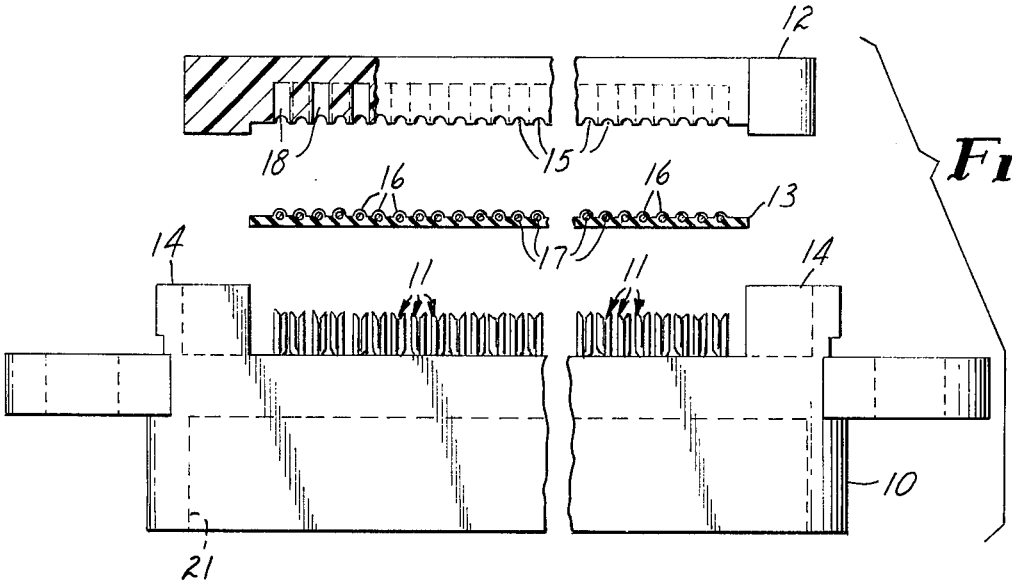
FIG. 1 is an exploded view, in elevation and partial section, of one illustrative form of connector as applied to a flat cable.
Figure 2:
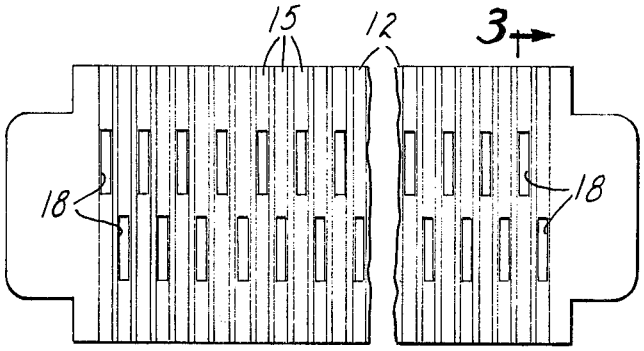
FIG. 2 is a bottom plan view of the cover member of FIG. 1.
Figure 3:
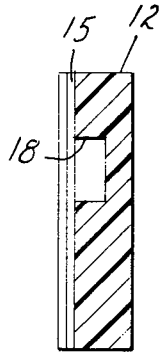
FIG. 3 is a transverse section of the cover taken approximately along line 3—3 of FIG. 2.
Figure 4:
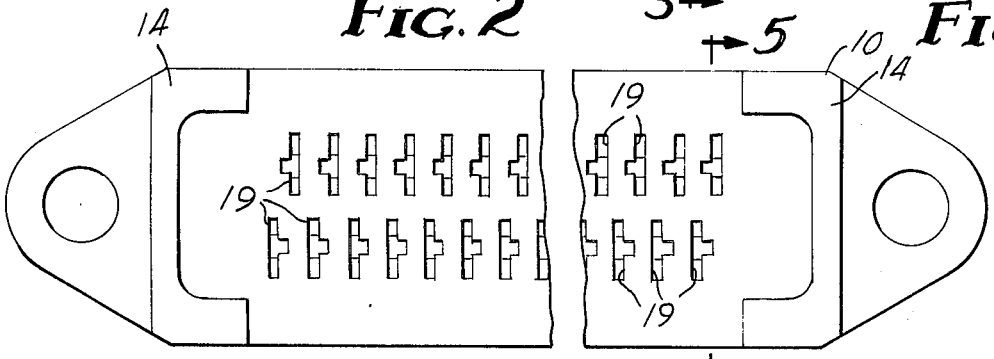
FIG. 4 is a top plan view of the base member of FIG. 1.
Figure 6:
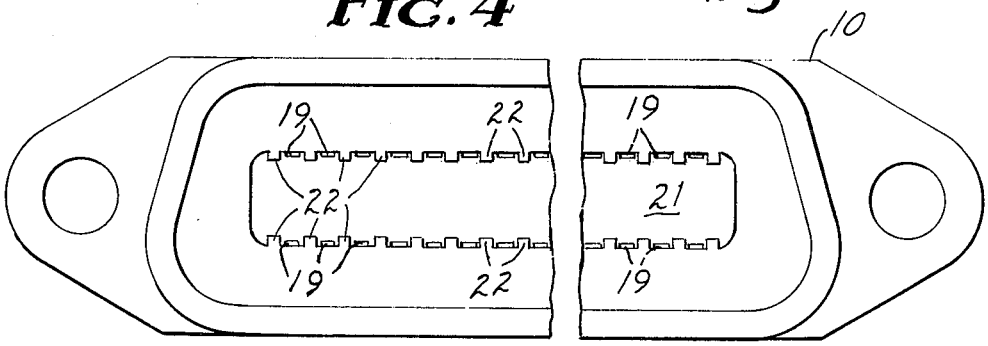
FIG. 6 is a bottom plan view of the base.
Figure 5:
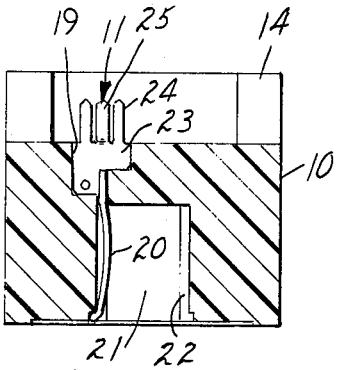
FIG. 5 is a transverse section of the base with a contact element inserted and taken approximately along line 5—5 of FIG. 4.

The connector of FIG. 1 comprises a base 10 fitted with contact elements 11, and a cover 12. An external clamp or other holding means, not shown, may be included if desired for more securely holding the cover to the base; and mounting means, such as the terminal perforate ears illustrated, may be provided for use in attaching the base to a panel or other support. The flat cable 13 fits between the upraised ends 14 of the base, and between the base and cover. Precise alignment is assured both by the ends 14 and by the transverse grooves 15 in the lower surface of the cover 12, the grooves receiving the corresponding upraised ridges 16 overlying the parallel wire conductors 17 of the cable 13.

The cover 12 is further provided with narrow pockets 18 for receiving the prongs of the elements 11, the tips of which press against the side walls of the pockets when the connector is assembled on the cable. The base 10 is correspondingly slotted at slots 19 to receive the elements 11, the extended curve legs 20 of which are disposed within the open cavity 21 provided in the base. The legs 20 of the several elements 11 lie along both side walls of the cavity, being separated by projections 22.

Figure 7:
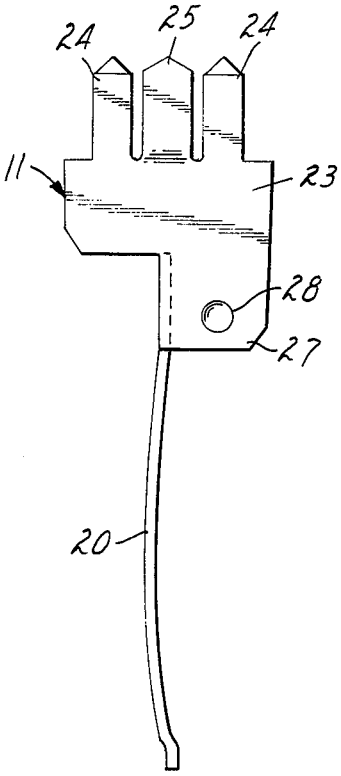
FIG. 7 is a side elevation and FIG. 8 an edge elevation of a contact element, on an enlarged scale, of the connector of FIG. 1.
Figure 8:
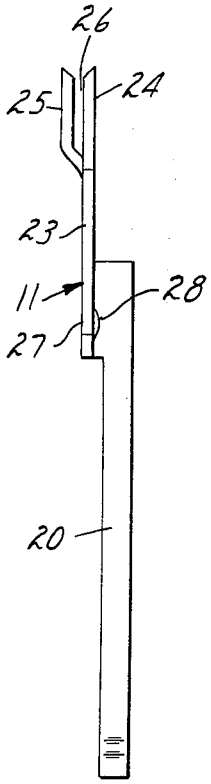

Each of the contact elements 11 comprises a flat body 23 having two sharp-ended outer prongs 24 of equal width and a sharp-ended central prong 25 of about ⅓ to ⅔ greater width extending from the upper edge as shown in FIG. 7. Prongs 24 remain coplanar with the body 23 while prong 25 is in a plane parallel to that of the body but is displaced not more than about twice the thickness of the plate, leaving an opening 26 between the adjacent planar surfaces approximately the thickness of the plate and which is not more than about three-fourths the diameter of the smallest wire to which connection is to be made. The ends of the prongs 24 and 25 are pointed and slope downwardly toward the opening 26 as shown in FIGS. 7 and 8, thereby defining a wire-receiving trough. The body 23 extends downwardly at one side to form a body extension 27 and a curved contact leg 20 folded at a right angle therefrom, and which extends into the cavity 21 between adjacent protrusions 22 of the base 10. The leg 20 then serves as a contact member for making sliding contact with a cooperating spring contact element of a connector plug, not shown, fitting within the cavity 21. The extension 27 is frictionally held within the slot 19 by a proturberance 28 which presses against the wall of the slot.

In an illustrative Example, a contact element used in a connector for a flat cable containing 26 gage solid or 28 gage stranded copper wire laid on 0.0425 inch centers is made of 0.0100 inch ¼ hard copper alloy No. 172 and is heat treated to full hardness. The outer prongs are 0.030 inch wide, the central prong is 0.040 inch wide, and the spaces between prongs are 0.010 inch wide prior to offsetting of the central prong by 0.020 inch. The prongs extend 0.090 inch above the body of the element.

Figure 9:
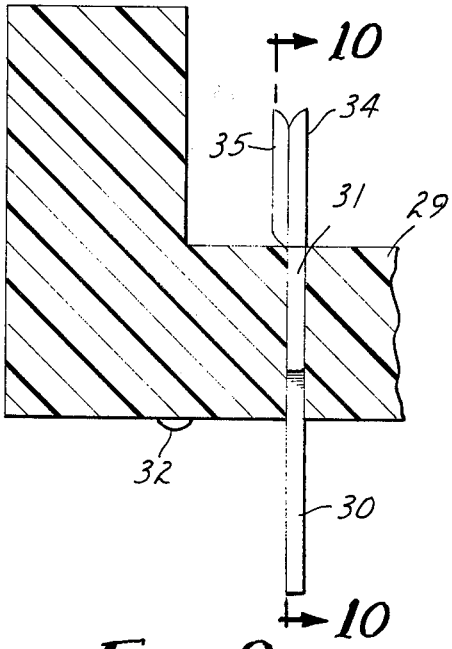
FIG. 9 is a partial longitudinal section and FIG. 10 is a partial transverse section taken approximately along line 10—10 of FIG. 9, of an alternative form of base and contact element.
Figure 10:
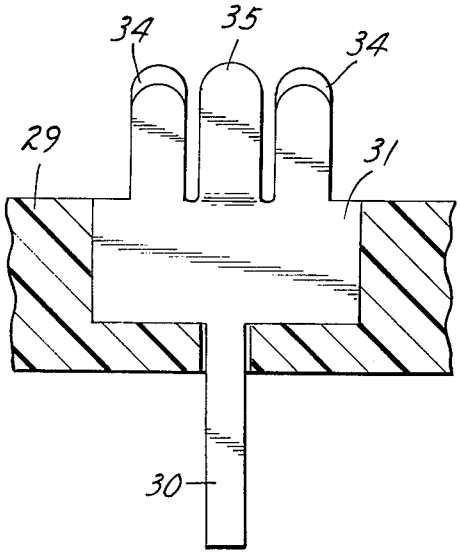

FIGS. 9 and 10 illustrate an alternative base and element structure adapted for use with printed circuit boards. The base 29 has a generally flat bottom through which there extends a pin 30 replacing the curved leg 20 of the element of FIGS. 7 and 8. The extended pins then fit into suitable apertures in a PC board, from the surface of which the base 29 is separated by spacers 32.

Figure 11:
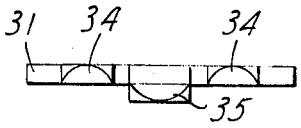
FIG. 11 is a top plan view of the contact element of FIGS. 9 and 10.

The ends of the prongs 34, 35 of the element 31 of FIG. 10 while being sharpened for piercing the insulation of a flat cable are rounded rather than pointed as in the element 11. The central prong 35 is offset from the plane of the outer prongs 34 by the thickness of the plate, as shown in FIG. 11.

An illustrative Example of such an element adapted for use in a connector for flat cable containing 32 gage solid copper wires laid on 0.025 inch centers is made of 0.008 inch full hard beryllium copper plate, the prongs and slots being otherwise dimensioned as in the previous Example except that the displacement of the center prong is 0.008 inch, i.e. the thickness of the plate.

The base and cover in both Examples are formed of plastic insulating material such as glass filled polyester or nylon thermoplastic polymer.

Various combinations of these and other alternative structures are likewise contemplated.

Surprisingly, it has been found that electrical connections made with these pronged connectors are fully equal in electrical conductivity to those made with the prior art spring compression reserve contact elements.

It has additionally been discovered that these pronged connectors are particularly effective in making electrical connection with stranded conductors. The serpentine or sinuous lay of the conductor obtained within the contact element, resulting in a series of edge or corner contacts at the edges of the several prongs, negates any tendency of the strands to be displaced away from the contact area and assures full conductive contact between element and conductor.

What is claimed is as follows:

1. A wire-connector for making solderless connection to wires of a compact flat cable, comprising a contact element having a flat metal plate body having parallel closely spaced sharp-ended prongs extending from one edge, including two outer prongs lying in a common plane and an inner prong lying in a plane parallel to said plane and offset therefrom by no more than twice the thickness of said plate, the ends of said prongs sloping inwardly toward the space between said planes to define a terminal wire-receiving trough.

2. Wire-connector of claim 1 including an insulating base for supporting a said cable and containing at least one said contact element in position for making contact with a corresponding wire, and an insulating cover for retaining said cable in position against said base and having pockets for receiving the extended prongs of said elements.

3. Wire-connector of claim 2 wherein said elements include an extension opposite the extended prongs and passing through at least a portion of said base for providing an external contact.

* * * * *